US009683571B2

(12) United States Patent
Morrison et al.

(10) Patent No.: US 9,683,571 B2
(45) Date of Patent: Jun. 20, 2017

(54) CENTRIFUGAL PUMP STAGE WITH INCREASED COMPRESSIVE LOAD CAPACITY

(71) Applicant: Schlumberger Technology Corporation, Sugar Land, TX (US)

(72) Inventors: Tony R. Morrison, Caney, KS (US); David Milton Eslinger, Collinsville, OK (US); Kean Wee Cheah, Singapore (SG); Lye Heng Chang, Singapore (SG); Raju Ekambaram, Singapore (SG); Narayanan Lakshmanan, Singapore (SG)

(73) Assignee: SCHLUMBERGER TECHNOLOGY CORPORATION, Houston, TX (US)

( * ) Notice: Subject to any disclaimer, the term of this patent is extended or adjusted under 35 U.S.C. 154(b) by 590 days.

(21) Appl. No.: 14/171,653

(22) Filed: Feb. 3, 2014

(65) Prior Publication Data

US 2014/0294575 A1 Oct. 2, 2014

Related U.S. Application Data

(60) Provisional application No. 61/807,023, filed on Apr. 1, 2013.

(51) Int. Cl.

| | |
|---|---|
| ***F04D 1/06*** | (2006.01) |
| ***F04D 29/44*** | (2006.01) |
| ***F04D 29/54*** | (2006.01) |
| ***F04D 29/64*** | (2006.01) |

(52) U.S. Cl.
CPC ..... *F04D 1/063* (2013.01); *F04D 29/445* (2013.01); *F04D 29/548* (2013.01); *F04D 29/648* (2013.01)

(58) Field of Classification Search
CPC ..... F04D 29/445; F04D 29/648
See application file for complete search history.

(56) References Cited

U.S. PATENT DOCUMENTS 3,070,026 A * 12/1962 Lung ..... F04D 13/10 415/199.3
3,171,355 A * 3/1965 Harris ..... F04D 13/04 415/116
4,172,690 A * 10/1979 Kuntz ..... F04D 1/063 415/174.2

(Continued)

*Primary Examiner* — Craig Kim
*Assistant Examiner* — Jason Davis
(74) *Attorney, Agent, or Firm* — Michael Stonebrook

(57) ABSTRACT

A centrifugal pump stage with increased compressive load capacity is provided. In an implementation, a centrifugal pump stage includes a diffuser with outside wall capable of supporting increased axial forces. A mating surface of the outer wall can support axial forces generated by a stack of subsequent pump stages across the entire thickness of the outer wall. The diffuser can be a two-piece assembly including a load bearing module and a flow diffusing module. The load bearing module may be a cylinder of strong tubular alloy while the flow diffusing module can be separately cast in a manner that improves hydraulic efficiency. Various means for radially positioning the pump stages relieve the load bearing module from the task of aligning additional pump stages. A single rigid tube may also be used as the load bearing module for multiple pump stages. The tube may be made with a thin wall to increase pump volume.

12 Claims, 6 Drawing Sheets

(56) References Cited

U.S. PATENT DOCUMENTS 4,406,582 A * 9/1983 LaGrange ..... F04D 13/10
220/210
4,806,083 A * 2/1989 LaGrange ..... F04B 53/00
264/272.2

* cited by examiner

CENTRIFUGAL PUMP STAGE WITH INCREASED COMPRESSIVE LOAD CAPACITY

RELATED APPLICATIONS

This patent application claims the benefit of priority to U.S. Provisional Patent Application No. 61/807,023 to Morrison et al, filed Apr. 1, 2013, and incorporated herein by reference in its entirety.

BACKGROUND

In an electric submersible pump, centrifugal pumps are often ganged into a stack of pump stages. Each centrifugal pump has an impeller and a diffuser, and the diffuser provides a housing that is also the structural member for supporting the other overlying pump stages. Since diffusers are typically made from castings to enable forming of the vanes, the load carrying walls are typically weak. The bottommost diffusers in a stack, for example in a long housing high-pressure pump, can experience high axial compressive loads resulting in yielding of these diffusers. Further, discharge fluid that leaks into the diffuser or housing annulus can cause collapse failure of the diffusers.

SUMMARY

A centrifugal pump stage of a multi-stage pump for producing a downhole fluid has a diffuser for diffusing hydraulic flow. An outer wall of the diffuser is capable of mating with a second diffuser and capable of supporting, across its entire wall thickness, an axial compressive load that is being transmitted through subsequent pump stages. The diffuser may be constructed as two components having separate manufacture. A load bearing component provides structural support through a high-strength outer wall and may be manufactured from high-stiffness tubular alloy, while the flow diffusing component may be cast in a manner that improves hydraulic efficiency. This summary section is not intended to give a full description of a centrifugal pump stage with increased compressive load capacity, or to provide a list of features and elements. A detailed description of example embodiments follows.

DETAILED DESCRIPTION

This disclosure describes a centrifugal pump stage with increased compressive load capacity. The increased capacity for bearing an axial compressive load may be achieved in various ways. Different implementations are described below. Each implementation presents an embodiment that provides a diffuser and pump stage with increased compressive load capacity.

Figure 1:
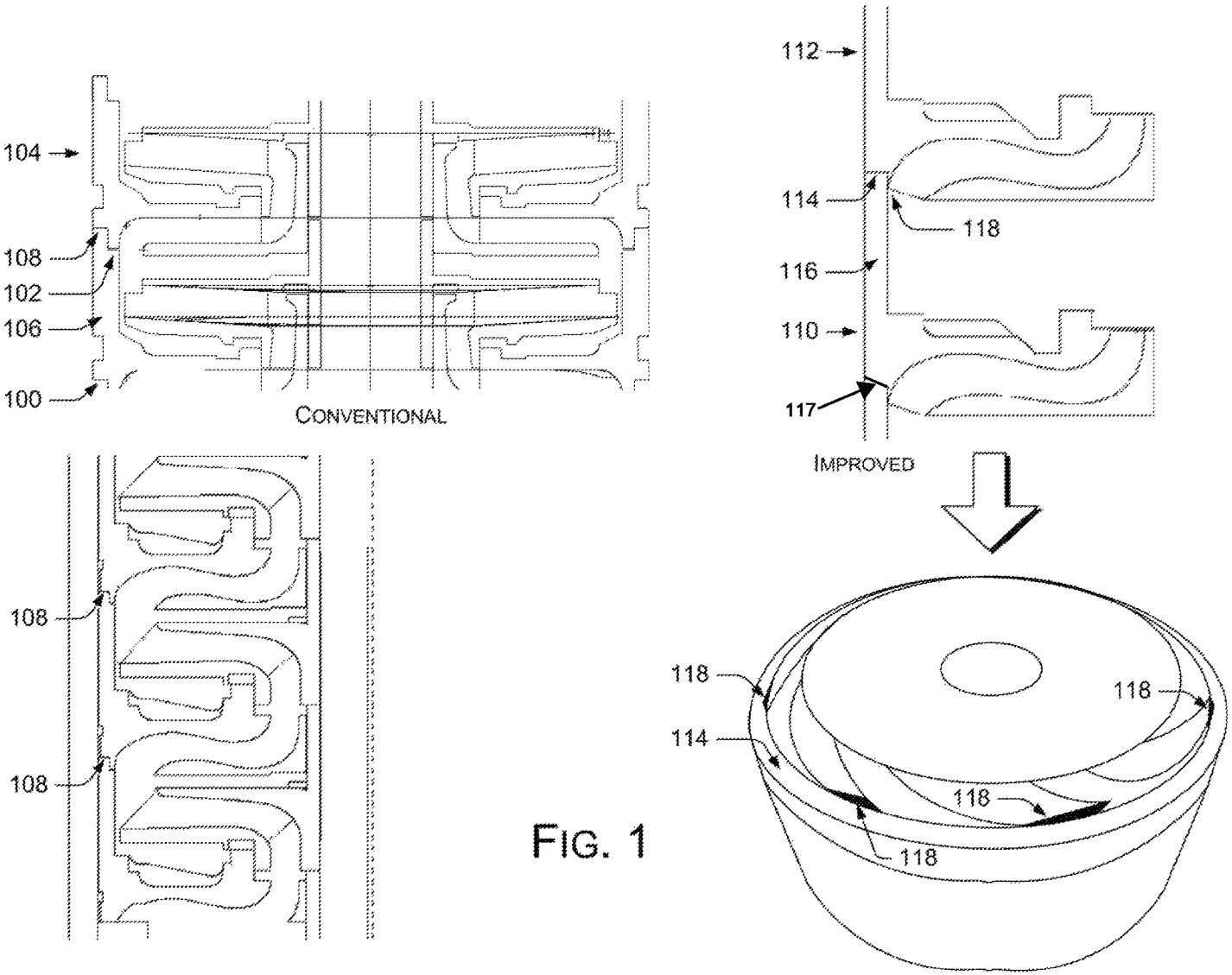
FIG. 1 is a diagram of an example centrifugal pump diffuser with increased capacity for axial compressive load.

As shown in FIG. 1, a conventional diffuser 100 of a conventional pump stage includes a nesting feature 102 for centering or radially locating a next adjacent pump stage 104. However, the nesting feature compensates part of the outer wall 106 of the diffuser 100 so that compressive load on the diffuser 100 is carried only by part 108 of the outer wall of the diffuser 100. The remainder of the wall is required for a locating pilot. Thus, the axial load-bearing capacity of the diffuser is weakened.

In an implementation, an example diffuser 110 supports the next adjacent diffuser 112 across the entire wall cross-section or outer wall thickness 114 of the diffuser 110. Since the nesting feature 102 has been removed from the outer wall 116, the adjacent diffusers 110 & 112 are radially located using a tip feature 118 on or near the leading edges of the diffuser vanes. This allows the entire diffuser wall to carry axial load, and none of the outer wall thickness is wasted for radial locating features.

In another implementation, all diffuser nesting features are removed from the outer wall 116 of the diffuser 110 and radial locating is achieved entirely by controlling fit of mating parts from inside the pump housing. This also leaves the entire outer wall 116 of the diffuser 110 available to carry the axial compressive load.

In another implementation, diffuser mating faces are tapered 117 so that the full cross-section of each outer wall 116 is available to carry axial load while also providing radial location of adjacent diffusers.

In another paradigm for increasing the axial load bearing capacity of a pump stage, some main functions of the conventional "cast" pump diffuser are separated out into corresponding hardware components, to create a composite diffuser. Thus, in an implementation, the tubular "wall" of the diffuser is separated from the "body" of the diffuser, which contains the vaned flow passages. The geometric design of a conventional diffuser is complex with intricate flow channels. Hence, conventional diffusers are traditionally made out of castings as a whole unit having uniform physical properties. But functionally, different sections of a diffuser serve different purpose, i.e., the diffuser wall acts as the structural member to carry axial load and the flow region does the hydraulic work.

An example composite diffuser can be assembled from a tubular or cylindrical load bearing component or module, and a flow diffusing component or module. The two modules can be manufactured separately and assembled together to obtain the final diffuser geometry. The load bearing module can be of simple cylindrical geometry, which can be made of stiffer material to increase its load bearing capacity, and the flow diffusing module can be manufactured separately, using methods focused on improving hydraulic efficiency.

This separation of functions into separate hardware components provides many benefits. For example, the two-piece construction enables high-strength tubing to be used for the outer wall of the diffuser, which provides the structural strength in a multi-stage centrifugal pump.

The flow diffusing module can be manufactured as a standard casting followed by machining or by other advanced manufacturing techniques including but not limited to powder metallurgy, powder injection molding, etc. depending on the required material, geometric complexity, surface finish, accuracy, cost, etc., of the final part.

The load bearing module can be machined-off from commercially available tubular raw materials, or by other means, including but not limited to forging, roll forming, etc. to have suitable mechanical properties.

As a final assembly step, the two modules can be fitted together by employing a suitable metal joining process including but not limited to a threaded joint, an interference fit, a friction weld, etc. The joint has sufficient shearing strength to overcome the reaction torque, in order to prevent the diffuser from spinning during the operation of the pump.

Assembling the diffuser as two separately manufactured components has advantages that include:

A stiffer diffuser wall, able to take higher compressive load, thereby reducing failures caused by spinning/collapsed diffusers, A larger design space, allowing a design that includes an impeller with a large outside diameter, thereby increasing the hydraulic performance for a given housing diameter, Better design for re-manufacturability, since preloaded diffusers maintain their geometric accuracy and do not have a permanent set along the stack height which is inherent in grey iron castings, Increases the casting yield, since the walls which take up about 50% of the castings weight are be removed from casting, Reduction of machining time, since the diffuser wall need not be machined from the castings anymore, Reduction in machining scrap, since the assembly-critical stack height dimension is taken out of the casting process and can be mass produced separately from tubes.

Figure 2:
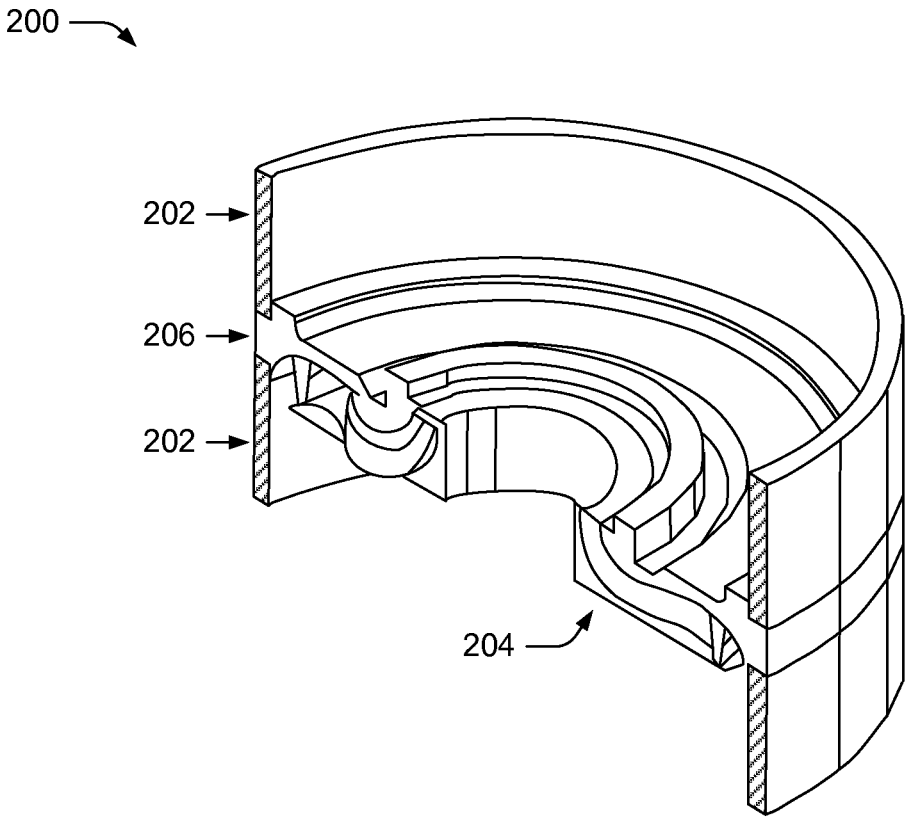
FIG. 2 is a diagram of an example composite diffuser including a load bearing component and a flow diffusing component.

FIG. 2 shows an example diffuser 200 assembled as at least one load bearing component 202 and a flow diffusing component 204. In an implementation, a shoulder 206 on the cast body of the flow diffusing component 204 is sandwiched between diffuser "tubes" (the load bearing components 202) to form a single diffuser 200.

Figure 3:
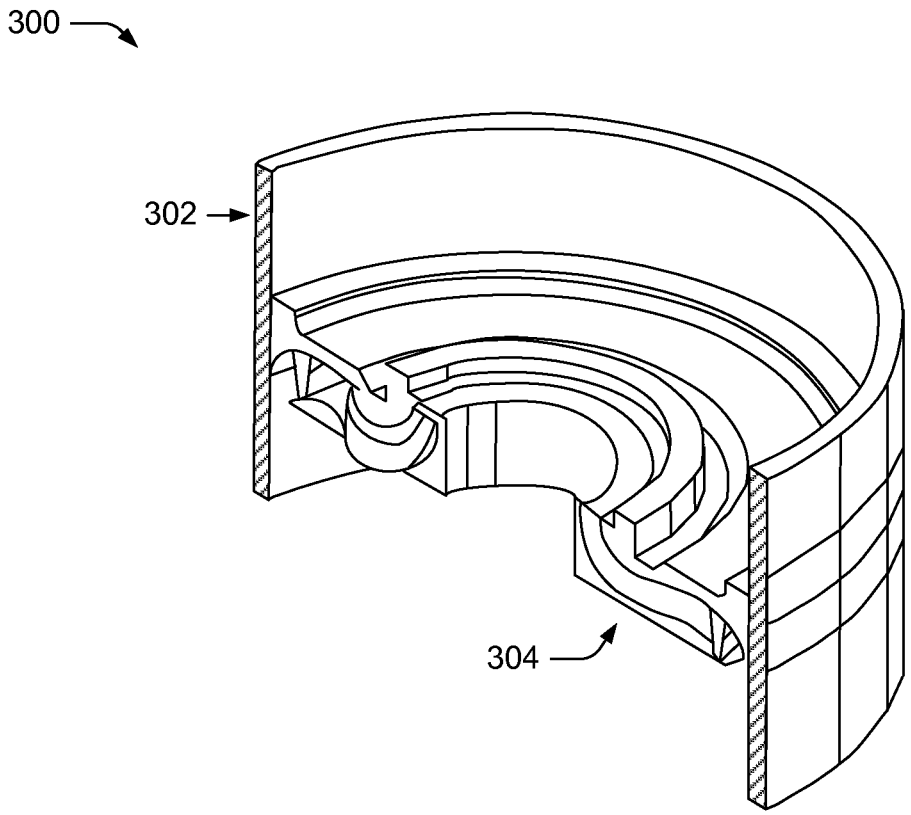
FIG. 3 is a diagram of an example composite diffuser in which the load bearing component is a continuous tube.

FIG. 3 shows another implementation of an example diffuser 300, in which the load bearing component 302 is a continuous tube. The cast body of the flow diffusing component 304 is located inside the continuous diffuser "tube" (the load bearing component 302) to form a single diffuser 300. The cast body can be fixed to the continuous tube load bearing component 302 by various means, for example, brazing, press-fit, welding, adhesives, swaging, and so forth.

Figure 4:
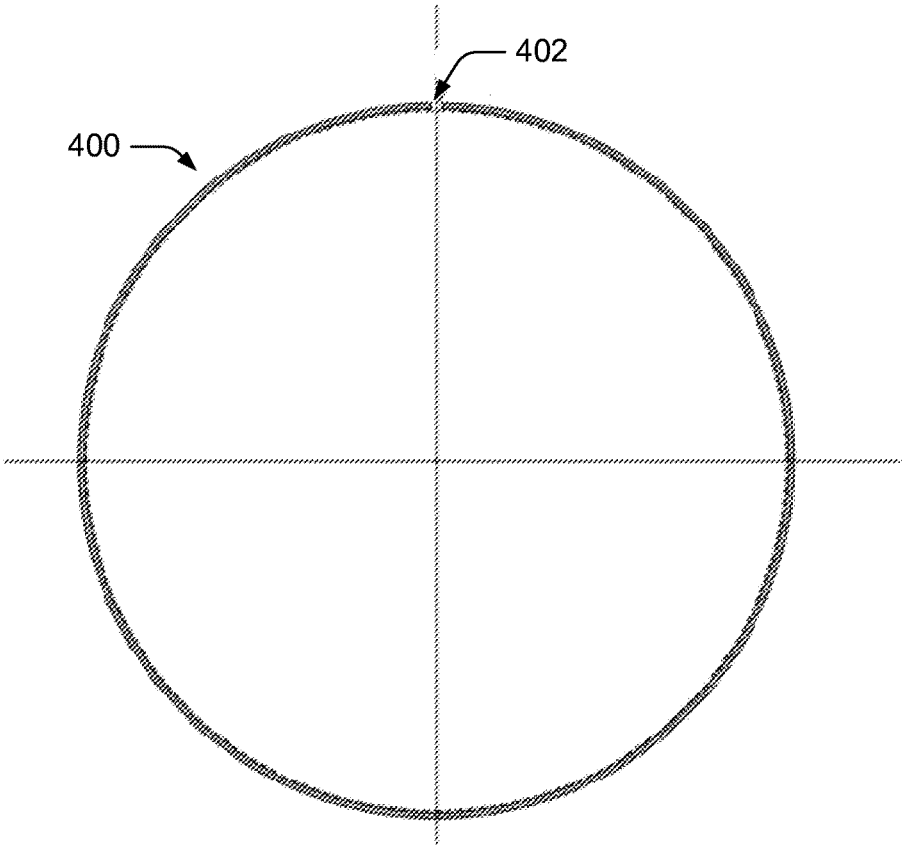
FIG. 4 is a diagram of an example tapered sleeve used to secure a flow diffusing component to a load bearing component during assembly of a composite pump diffuser.
Figure 4:
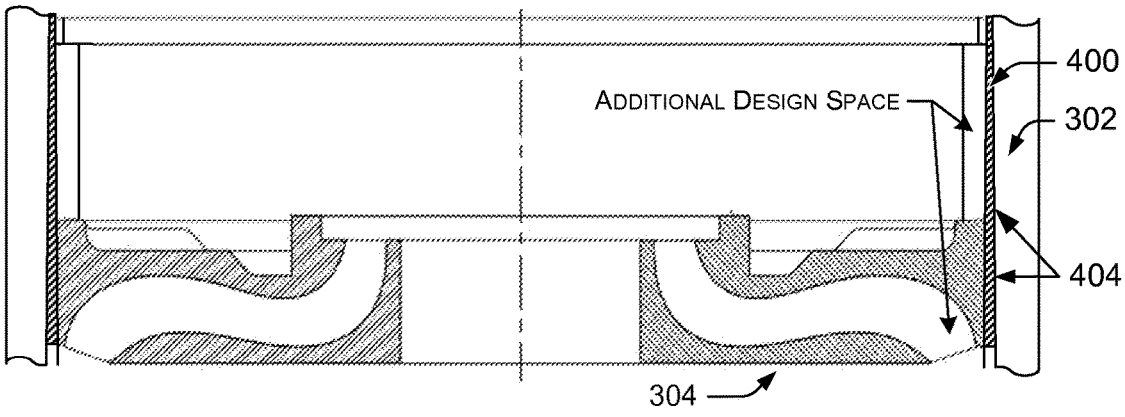

In a variation, the cast body of the flow diffusing component 304 is joined to the continuous tubular load bearing component 302 using a tapered fit. For example, as shown in FIG. 4, a wedged or tapered sleeve 400 may be used to secure the flow diffusing component 304 to the load bearing component 302. A slot 402 in the tapered sleeve 400 allows for slight radial change, radial growth, and thermal expansion and contraction, as well as adjustment in the tightness of the fit, with more axial compression forcing a greater radius of the tapered sleeve 400.

A sintered surface or a roughened surface 404 having a high coefficient of friction may also be used to lock the tapered sleeve 400 against the inside diameter of the load bearing component 302. In an implementation, a wedge-shaped diffuser and sleeve expand the sleeve outside diameter to lock the flow diffusing component 304 in place during assembly. During operation, greater down-thrust forces lead to higher radial push, securing the flow diffusing component 304 even more firmly in place. For example, a 0.08 inch radial translation can be achieved using a 1.55 degree taper over a 1.5 inch axial length.

Figure 5:
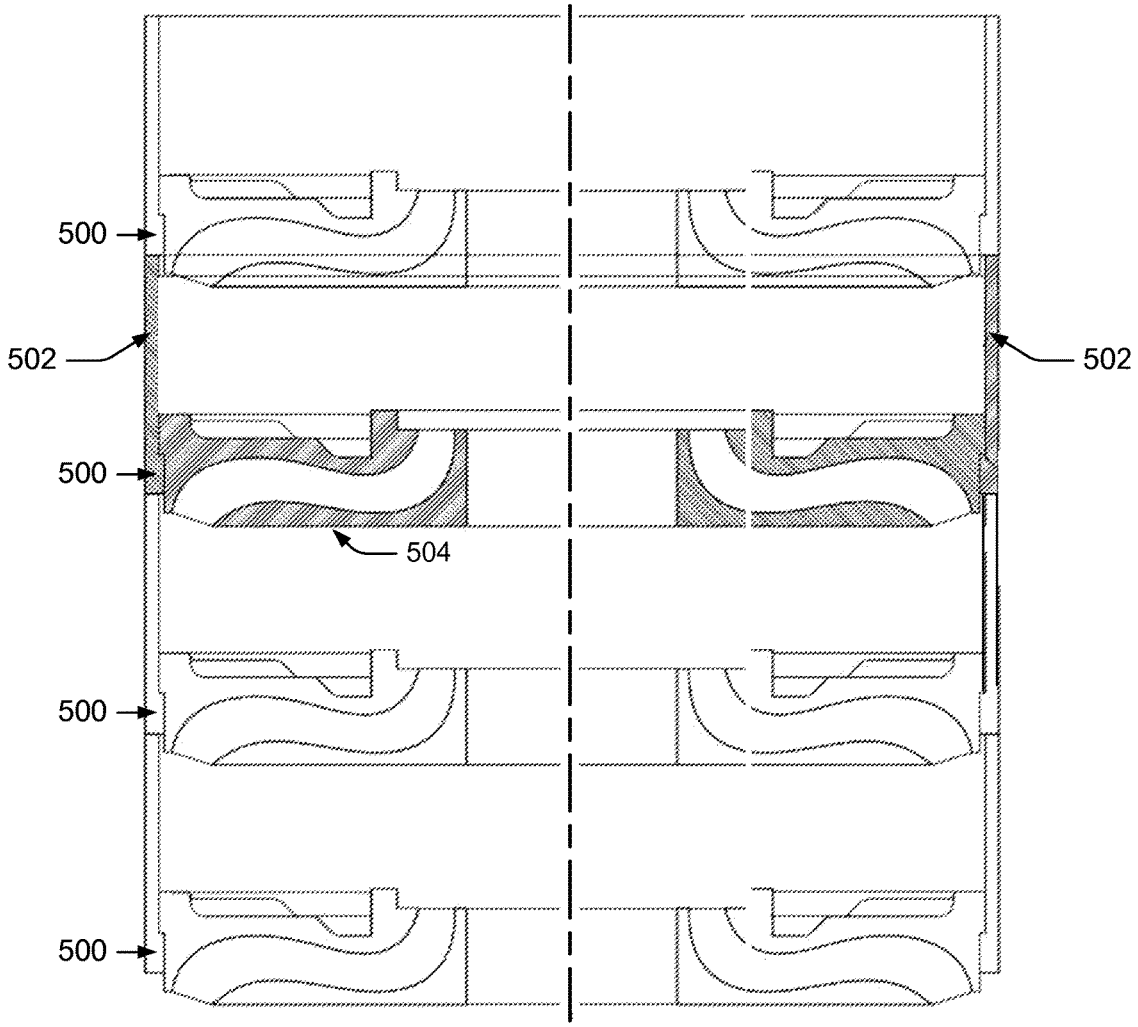
FIG. 5 is a diagram of an example diffuser stack in which a load bearing component has shoulders to anchor each stage of a flow diffusing component.

FIG. 5 shows another implementation, in which a ledge or shoulder 500 is provided in the continuous tubular load bearing component 502 for each flow diffusing stage 504 included. Each ledge or shoulder 500 enables a corresponding flow diffusing component 504 to transfer downthrust forces to the load bearing component 502. In one implementation, a spot weld or other fixation means is used to arrest the flow diffusing component 504 from moving up away from the ledge or shoulder 500 during upthrust.

In an implementation, the axial stiffness of an example diffuser design is increased by replacing the load carrying module with a high stiffness material in order to withstand higher compressive loads, and at the same time to reduce the diffuser wall thickness, which then provides a larger design space, i.e., a higher volume pump chamber, for example, or larger vanes. In an implementation, Ni-Resist walls of a diffuser are replaced with tubular alloys having a higher elastic modulus.

Figure 6:
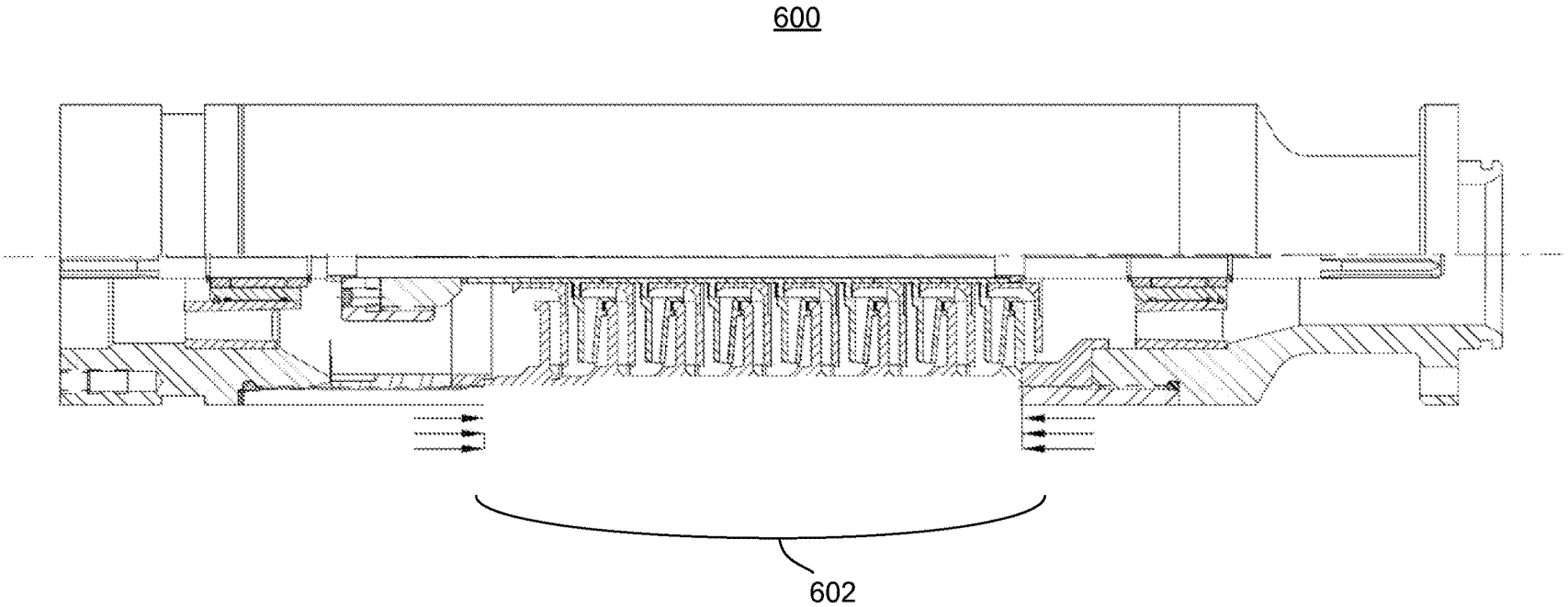
FIG. 6 is a diagram of an example diffuser stack with induced residual compression during manufacture to secure components together against forces to be experienced during operation.

In an implementation, maintaining high compressive load on a diffuser stack of a multi-stage pump assembly 600 as shown in FIG. 6 enables reliable operation of the multistage pump. The diffusers have to be held rigidly in place against the thrust of the rotating impellers during operation, if not, the diffusers can spin because of torque transferred from the impellers, resulting in early pump failure. Therefore, a multistage pump design benefits from the stack of diffusers being held rigidly under compression. A residual compression can be built into the stack during manufacture to create a highly compressed diffuser stack 602. By applying an amount of torque to the head and base, for example, with respect to housing during pump assembly, this induced residual compression can prevent diffuser spinning during operation.

CONCLUSION

Although only a few example embodiments have been described in detail above, those skilled in the art will readily appreciate that many modifications are possible in the example embodiments without materially departing from the subject matter. Accordingly, all such modifications are intended to be included within the scope of this disclosure as defined in the following claims. In the claims, means-plus-function clauses are intended to cover the structures described herein as performing the recited function and not only structural equivalents, but also equivalent structures. It is the express intention of the applicant not to invoke 35 U.S.C. §112, paragraph 6 for any limitations of any of the claims herein, except for those in which the claim expressly uses the words 'means for' together with an associated function.

What is claimed is:

1. An apparatus, comprising:

a first pump stage of a multi-stage centrifugal pump for producing a downhole fluid;

a first diffuser in the first pump stage, the first diffuser comprising an assembly of at least three pieces, the assembly including:

a load bearing module manufactured by a first process to impart a load bearing capacity to the load bearing module;

a flow diffusing module manufactured separately by a second process to impart a hydraulic efficiency to the flow diffusing module; and a tapered sleeve to secure the flow diffusing module to the load bearing module;

an outer wall of the first diffuser capable of mating with a second diffuser of a second pump stage; and an outer wall thickness of the outer wall supporting an axial load of the second pump stage across the entire outer wall thickness.

2. The apparatus of claim 1, further comprising vanes of the diffuser, the vanes having leading edges, and the leading edges having tips; and wherein the tips of the leading edges of the vanes radially locate the second diffuser with respect to the first diffuser by abutting against an inner surface of the outer wall while the outer wall of the diffuser supports the second diffuser across the entire thickness of the outer wall.

3. The apparatus of claim 1, further comprising a radial locator inside the pump housing to radially locate the second diffuser of the second pump stage on the first diffuser when mating the first diffuser and the second diffuser.

4. The apparatus of claim 1, further comprising a tapered mating surface on the outside wall of the first diffuser.

5. The apparatus of claim 1, further comprising a joint between each load bearing module and each flow diffusing module, and wherein the joint comprises one of an interference fit, a tapered fit, and a sintered fit.

6. The apparatus of claim 1, further comprising a surface having a friction coefficient sufficient to lock the flow diffusing module to the load bearing module.

7. The apparatus of claim 1, wherein a continuous tube comprises the load bearing module for multiple flow diffusing modules;

wherein the multiple flow diffusing modules are located inside the continuous tube; and wherein the continuous tube supports the axial load of multiple corresponding pump stages.

8. The apparatus of claim 7, further comprising at least one shoulder on the inside diameter of the continuous tube of the load bearing module; and wherein the at least one shoulder secures the flow diffusing module in place in the continuous tube.

9. A pump stage comprising:

a tubular component having an inside surface;

a tapered sleeve disposed inside the tubular component and in contact with at least a portion of the inside surface; and a flow diffusing component disposed within the tapered sleeve, the flow diffusing component secured within the tapered sleeve due to an interference fit between the flow diffusing component and the tapered sleeve.

10. The pump stage according to claim 9 wherein the tapered sleeve comprises a slot allowing radial expansion and radial contraction of the tapered sleeve.

11. The pump stage according to claim 9 wherein at least a portion of the inside surface of the tubular component is a sintered surface.

12. The pump stage according to claim 9 wherein at least a portion of the inside surface of the tubular component is a roughened surface.

* * * * *